United States Patent [19]

DeMarco et al.

[11] Patent Number: 4,547,417

[45] **Date of Patent: * Oct. 15, 1985**

[54] CORE PLUG

[75] Inventors: Richard E. DeMarco, Waldwick, N.J.; David Hopkins, Wilton; Dennis I. Deegan, Fairfield, both of Conn.

[73] Assignee: Westvaco Corporation, New York, N.Y.

[ * ] Notice: The portion of the term of this patent subsequent to Nov. 27, 2001 has been disclaimed.

[21] Appl. No.: 541,696

[22] Filed: Oct. 13, 1983

Related U.S. Application Data

[63] Continuation-in-part of Ser. No. 270,413, Jan. 4, 1981, abandoned.

[51] Int. Cl.[4] ..... B65D 85/67

[52] U.S. Cl. ..... 428/64; 242/68.6; 428/66; 428/131; 428/537.1

[58] Field of Search ..... 242/68.6; 428/64–66, 428/131, 537.1

[56] References Cited

U.S. PATENT DOCUMENTS

| | | | |
|---|---|---|---|
| 1,008,924 | 11/1911 | Orr | 242/68.6 |
| 1,180,955 | 4/1916 | Stuck | 242/68.6 |
| 1,492,248 | 4/1924 | Hachmann | 220/284 |
| 1,719,224 | 7/1929 | Haase | 220/284 |
| 1,871,907 | 8/1932 | Olt | 220/307 |
| 1,899,565 | 2/1933 | Gredell | 220/284 |
| 1,905,653 | 4/1933 | Schranz | 220/307 |
| 1,919,769 | 7/1933 | Brown et al. | 242/68.6 |
| 2,196,378 | 4/1940 | Bebie | 242/68.6 |
| 3,046,853 | 7/1962 | Legendre | 220/284 |
| 3,396,269 | 8/1968 | Sorenson | 220/307 |
| 3,547,367 | 12/1970 | Brazeale | 242/68.6 |
| 3,627,220 | 12/1971 | Vogel | 242/68.6 |
| 3,674,295 | 7/1972 | Padovani | 220/307 |
| 3,840,194 | 10/1974 | Vetter | 242/68.6 |
| 3,865,326 | 2/1975 | Beaudoin | 242/68.6 |
| 4,015,711 | 4/1977 | Mason | 242/68.6 |
| 4,303,176 | 12/1981 | Swartzdaugh | 220/306 |
| 4,460,087 | 7/1984 | DeMarco et al. | 206/415 |
| 4,484,715 | 11/1984 | DeMarco et al. | 242/68.6 |

FOREIGN PATENT DOCUMENTS 952433 3/1964 United Kingdom .

OTHER PUBLICATIONS

Brochure dist. by Moldwood Corp., York, Alabama 36925.

"Construction Methods", Jan. 1943, p. 60.

*Primary Examiner*—George F. Lesmes

*Assistant Examiner*—P. R. Schwartz

[57] ABSTRACT

A solid core plug formed from wood, metal, plastic or a composite woody material of substantially cylindrical shape with a body portion and an integral tapered forward portion. The outer face of the body portion has a diameter substantially equal to the inside diameter of the core for which the core plug is intended, and the inner face of the forward portion is of slightly less diameter than the outer face to facilitate entry of the core plug into the ends of a core. The core plug includes an opening or groove spaced from the center thereof and preferably within the outer one-half of the radius of the core plug which extends the full length thereof for facilitating removal of the core plug from a core.

4 Claims, 6 Drawing Figures

CORE PLUG

This application is a continuation-in-part of pending application Ser. No. 270,413, filed Jan. 4, 1981, now abandoned.

BACKGROUND OF INVENTION

The present invention relates generally to an improved core plug for protecting the ends of hollow paper cores on which paper, plastic, fabric and other material is wound for storage, shipment and use. More particularly, the present invention relates to a core plug formed from wood, metal, plastic, or a composite woody material that has increased strength over existing core plugs as a result of the development of a novel means for removing the core plugs from cores after use.

In paper mills, textile mills and the like, rolls of paper and/or fabric are generally wound on tubular cores which are usually made of a paper material such as cardboard or paperboard. These cores are relatively strong except that they are vulnerable at their ends where they can be easily damaged. During shipment and handling, the rolls of paper and other materials are repeatedly jostled, picked up and moved, and if the core ends become deformed in any way, the entire roll of paper or other material becomes unusable because it cannot be properly chucked. Thus, in order to protect such cores, core plugs are commonly inserted into the ends of the cores.

Core plugs are presently available in a number of sizes to accommodate different sized cores. Such core plugs are formed from a variety of different types of materials, and include various distinctive features to increase their strength and utility. However, in general, the majority of such core plugs are formed from wood or molded material. Molded wood core plugs are available from Moldwood Corporation, Drawer 430, York, Ala. 36925. Core plugs supplied by Moldwood Corporation and as described in their sales literature are conventional in design with a centrally located hole for removing the core plugs from cores. Most core plugs must be removed before the rolls of paper, fabric or the like can be used. The core plugs may be removed by inserting a metal bar or rod into the hole provided in the plug where the plugs are wedged or pulled out. However, in general the metal bar or rod is inserted in the hole in one core plug and butted against the inside of the opposite core plug so that it can be driven out. Since core plugs may differ in size, the holes provided therein may also be of different size. Generally the bars or rods that are used to remove the core plugs are metal stock of from about $\frac{1}{2}$ to $\frac{3}{4}$ inch in diameter. Thus the holes in the core plugs must be at least as large as the bars or rods used to remove them.

Other core plug designs are disclosed in U.S. Pat. Nos. 4,015,711; 3,627,220; 3,547,367; 2,196,378; and 1,919,769. The core plugs described in the aforementioned patents are in the form of shells made from plastic materials or metal, and with the exception of the core plug disclosed in U.S. Pat. No. 2,196,378, all include a centrally located hole for removing the core plugs from a core. In U.S. Pat. No. 2,196,378, the core plug includes a pair of intersecting ribs which divide the face of the core plug into four quadrants. Thus, in order not to inhibit the increased strength provided by the intersecting ribs, the hole for removing the core plug is located off center in one of the quadrants.

Notwithstanding the features and advantages described for the core plugs presently in use, the core plug of the present invention offers increased strength and durability over existing core plugs.

SUMMARY OF INVENTION

The present invention relates to an improved core plug made from wood, metal, plastic, or a composite woody material. The core plug of the invention comprises a solid body portion with an integral tapered forward portion of substantially cylindrical shape. The outer face of the body portion has a diameter that is substantially equal to the inside diameter of the core for which the core plug is intended. Meanwhile, the inner face of the forward portion of the core plug is of slightly less diameter than the outer face to facilitate entry of the core plug into the end of a core. In this form, the core plug of the present invention has considerable strength since it does not contain the usual center hole which is used to remove a conventional core plug from a core when it is desired to chuck the core for mounting on an unwinder, rewinder or the like. In contrast to the prior art, the core plug disclosed herein is provided with an opening or groove spaced from the center of the plug and near its remote outer surface which extends the full length thereof. This arrangement permits the core plugs of the present invention to be readily and easily removed from cores in the normal fashion using a standard core plug remover as described hereinbefore. However, because the core plugs of the present invention do not contain the usual center hole, they are much stronger than conventional prior art core plugs made from the same material.

Accordingly it is an object of the present invention to provide an improved core plug for protecting the ends of hollow paperboard cores, with plain or reinforced ends, on which paper, plastic, fabric and other material is wound for storage, shipment and use.

Another object of the present invention is to provide a core plug of increased strength that is a result of the omission of the usual center hole required for removing the core plug from a core.

The core plug of the present invention is preferably made of wood, plastic or a composite woody material in a mold, or machined from stock where desired. An example of a composite woody material is molded wood which may be defined as a composition of wood shavings, chips or sawdust, resins and/or glue which is mixed together and heated under pressure in a mold to produce the desired shape. The significant point is that the core plugs of the present invention are substantially solid bodies which include a core plug removing opening or groove spaced from the center.

Other and further objects of the invention will become more apparent from a consideration of the following detailed description taken with the accompanying drawing.

DETAILED DESCRIPTION

Figures 1, 2, 3:
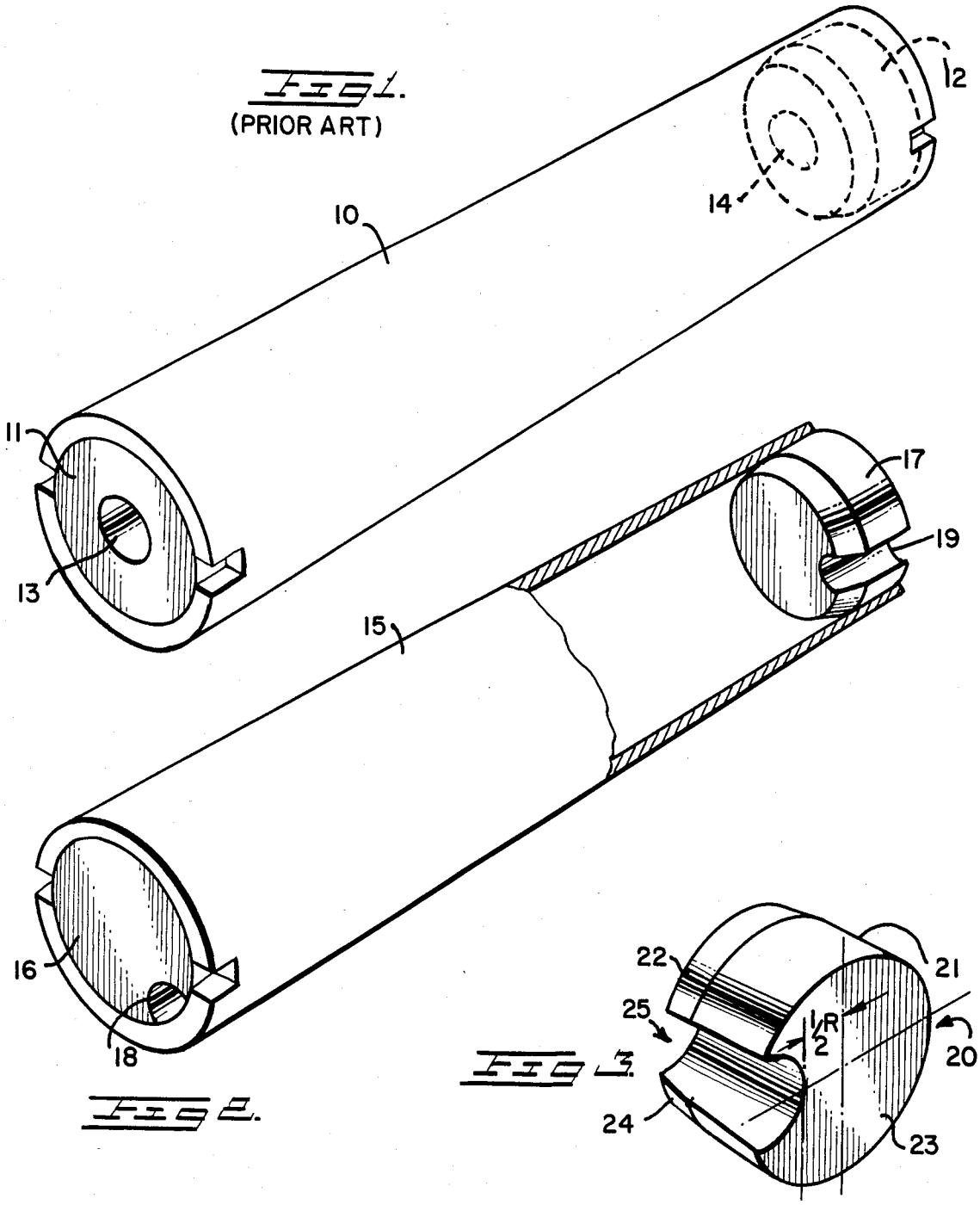
FIG. 1. (PRIOR ART)
FIG. 1 is a perspective view of a typical core having conventional prior art core plugs located in each end.
FIG. 2 is a perspective view with one end in section showing a tubular paper core with both ends reinforced with core plugs made according to the present invention.
FIG. 3 is an enlarged perspective view of a core plug made according to the present invention.

As shown in FIG. 1, an elongated paper core 10 is illustrated with a pair of conventional end core plugs 11,12 inserted in each end. The conventional core plugs each include centrally located holes 13,14 through which a core plug removing bar can be inserted for removing the core plugs. These core plugs 11,12 serve to protect the ends of the core 10 during storage and shipment by absorbing impact shocks during handling and crushing loads during shipment. Meanwhile, FIG. 2 illustrates the novel core plug design according to the present invention.

In FIGS. 2 and 3, a typical paperboard core 15 is illustrated with core plugs 16,17 inserted in each end. These core plugs 16,17 are preferably made from wood or a molded woody material but may be fabricated from other materials such as plastic where cost is no object. Each core plug 16,17 is provided with a core plug removing opening or groove 18,19 located at the outer surface thereof which gives the core plugs 16,17 greater crush strength than the conventional core plugs 11,12 shown in FIG. 1.

Figure 4:
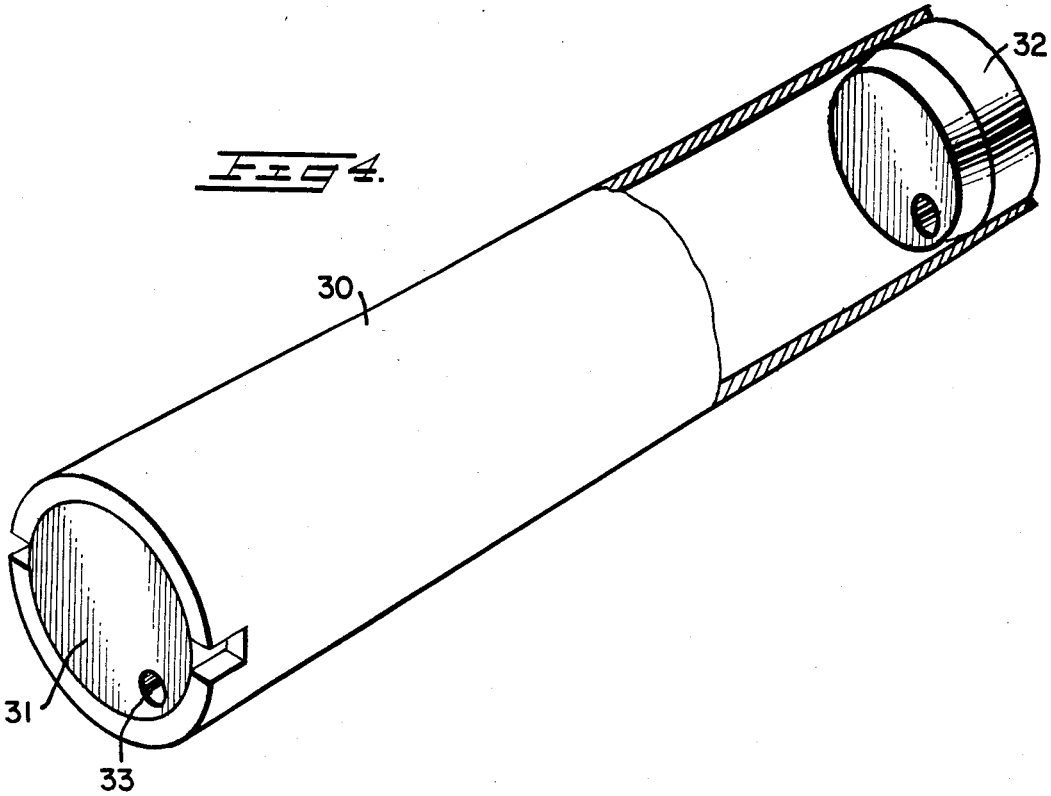
FIG. 4 is a perspective view with one end in section showing a tubular paper-core with both ends reinforced with core plugs made according to the present invention.
Figure 5:
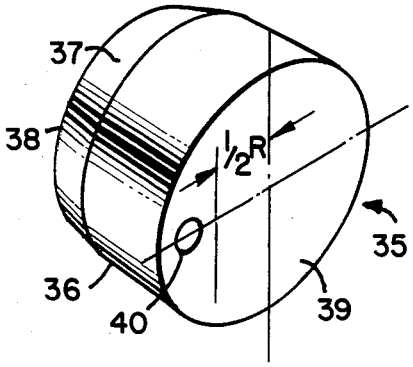
FIG. 5 is an enlarged perspective view of a core plug made according to the present invention; and, FIG. 6 is an end view of the core plug of FIG. 5.
Figure 6:
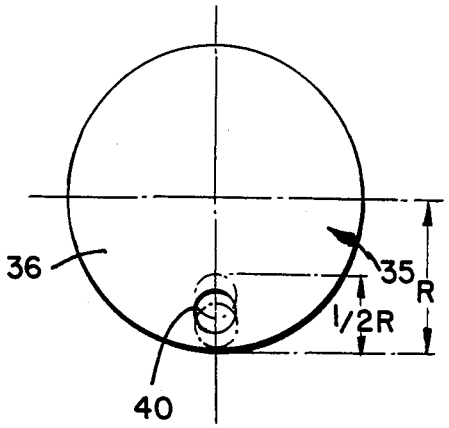

In FIGS. 4–6, a typical paperboard core 30 is illustrated with core plugs 31,32 inserted in each end. These core plugs are prepared from the same materials specified for FIGS. 2 and 3 and differ from the core plugs shown in FIGS. 2 and 3 only with respect to the location of the core plug removal openings. In FIGS. 4–6, the core plug removal openings 33,34 are located in the outer one-half of the radius of the core plugs, a location which has been shown to provide greater crush strength than the conventional core plugs 11,12 shown in FIG. 1, and nearly the same crush strength achieved with edge hole plugs as shown in FIGS. 2 and 3.

The increased strength has been demonstrated by the results of crush tests conducted on sample core plugs.

A series of core crushing experiments were conducted on wooden pine core plugs and molded core plugs to measure their resistance to crushing. The tests were conducted according to standard testing procedures established by the Composite Can and Tube Institute (CCTI).

In each case a core containing a core plug is placed in a compression testing machine having upper and lower platens which are held rigidly parallel during testing permitting movement in a vertical direction only. The speed of the moving platen is set at ½ inch per minute. The core containing core plug is placed at the center between the two platens, and a crushing load is applied until the load becomes constant, or drops, indicating core plug failure, or the equipment reaches its load limit. The data is recorded on a strip chart and the applied load readings are taken from the curve in 0.1 inch increments.

EXAMPLE I

In this example a series of core crushing tests were conducted with wooden pine core plugs having a nominal outside diameter of about three inches. The results obtained from four separate tests using conventional core plugs and core plugs made according to the present invention were averaged to produce the data shown in Table I. The data shows that for wooden pine plugs, grain direction plays a major role in overall crush resistance. In the tests where the grain direction is aligned with the direction of applied force, crush strengths are generally higher than those obtained with the grain direction oriented perpendicular to the applied force. Where the grain direction is perpendicular to the direction of applied force, crush strength is influenced primarily by compression of the wood grain.

TABLE I

| Increments (inches) | Load Applied: Center Hole (lbs.) | Side Opening (lbs.) | Top Opening (lbs.) |
|---|---|---|---|
| Grain Direction Parallel To Force Applied | | | |
| .1 | 880 | 870 | 890 |
| .2 | 1270 | 1270 | 1100 |
| .3 | 1770 | 1800 | 1370 |
| .5 | 3200 | 3740 | 2530 |
| | Failed @ 0.51 (3540) | | |
| .7 | | 8310 | 4960 |
| | | | Failed @ 0.80 (6620) |
| .9 | | 10000* | |
| Grain Direction Perpendicular To Force Applied | | | |
| .1 | 810 | 910 | 800 |
| .2 | 1110 | 1180 | 970 |
| .3 | 1500 | 1530 | 1120 |
| .5 | 2440 | 2390 | 1820 |
| .7 | 3230 | 3050 | 2770 |
| | Failed @ 0.84 (3610) | | |
| .9 | | | 3830 |
| | | Failed @ 1.02 (3830) | |

*Load Limit of Compression Testing Machine

In the data shown in Table I, the reference "center hole" is to a conventional wooden pine plug with a core plug removing hole in the center. The references "side opening" and "top opening" are to core plugs made according to the present invention with the core plug turned so that the removal opening is located either at the side or top of the core plug. The data shows that the conventional core plug failed in each case before reaching the 0.9 inch increment of compression and a load of about 3600 pounds. With the grain aligned with the applied force, the center hole core plug failed at 3610 pounds compression. Meanwhile, the core plugs according to the present invention resisted failure until at least a greater force was applied. With the grain parallel to the applied force, and the core plug turned so the opening was on one side, there was no failure with the maximum of 10,000 pounds of load applied. With the same grain direction and the opening at the top (or bottom) the core plug failed at 6620 pounds. With the grain perpendicular to the applied force, and the opening at one side, the core plug failed at 3830 pounds. Meanwhile, with the opening at the top (or bottom), the core plug withstood the same load without failure.

EXAMPLE II

In this example a series of core crushing tests were conducted with molded wood plugs having a nominal outside diameter of about three inches. The results obtained from several separate tests using both styles of core plugs were averaged to produce the data shown in Table II. Only one set of data points were gathered since molded core plugs do not have the same grain effects encountered with solid wooden plugs.

TABLE II

| Increments (inches) | Load Applied Center Hole (lbs.) | Side Opening (lbs.) | Top Opening (lbs.) |
|---|---|---|---|
| .1 | 980 | 1160 | 1030 |
| .2 | 1700 | 1700 | 1370 |
| .3 | 2460 | 2430 | 1780 |
| .5 | 4910 | 5230 | 3360 |
| | Failed @ 0.50 (4980) | | |
| .7 | | 10000* | 6160 |
| .9 | | | 10000* |

*Load Limit of Compression Testing Machine

In the data shown in Table II, the references to "center hole", "side opening" and "top opening" are the same as described in Example I. In this test with molded plugs, the conventional center hole core plug failed at an average load of 4980 pounds. With the core plug manufactured according to the present invention, and the opening located at one side, there was no failure at 10,000 pounds and a deflection of 0.70 inch. When the core plug was turned to orient the opening at the top (or bottom), there was no failure at 10,000 pounds with a deflection of 0.89 inch.

EXAMPLE III

In this example, core crushing tests were conducted with molded wood plugs having a nominal diameter of about six inches and with the core plug removal opening located at various positions within the core plug. The objective of this test was to determine the optimum location for the core plug removal opening and to ascertain whether or not there was a general area within the core plug where the core plug removal opening could be located and still retain maximum crush resistance. Since the crush strength of these larger size core plugs exceeded 10,000 pounds, only the ultimate crush strength was recorded. The results are shown in Table III.

TABLE III

| Hole Location (core plug) | Hole Location (Test Apparatus) | Crush Strength (lbs.) |
|---|---|---|
| center | center | 11,630 |
| ¾" off center | Top | 14,630 |
| ¾" off center | Side | 14,950 |
| 2¼" off center | Top | 17,200 |
| 2¼" off center | Side | 17,230 |

In the data shown in Table III, the references to "¾ inch off center" and "2¼ inch off center" refer to the location of the center of the core plug removal hole measured from the center of the plug. The references to "top" and "side" describe the position of the core plug removal opening in the test apparatus. Thus, "top" means in the same plane as the applied load and "side" means that the opening was oriented to one side of the applied load. In each case, standard one inch diameter openings were drilled in otherwise solid core plugs. In the conventional plug, the hole was drilled at the center. In the other experimental plugs the holes were drilled with centers spaced ¾ inch and 2¼ inch from the center of the plug. Thus the holes in the experimental plugs were located generally within the inner one-half of the radius of the core plug and the outer one-half of the radius of the six inch diameter plugs. The results of the crush tests clearly show that the strength of the plugs increases as the hole is moved away from center with an optimum strength obtainable with openings located in the outer one-half of the radius of the core plug.

A typical example of a core plug according to the present invention is shown enlarged in FIG. 3. The core plug 20 has a solid cylindrical body portion 21 that fits tightly into the end of a core and an integral tapered forward portion 22 for facilitating entry of the core plug into the core. The outer face 23 of the core plug and the cylindrical body portion 21 are formed with a diameter that is substantially equal to the inside diameter of the core for which the core plug is intended. The inner face 24 of the core plug and the tapered forward portion 22 is of slightly less diameter than the outer face 23. The core plug 20 includes a core plug removal opening or groove 25 spaced from the center thereof at the outer peripheral surface which extends the full length of the core plug. In the case of solid wooden core plugs, the opening or groove may be applied to the core plug by milling, routing or drilling. Where the core plugs are molded, the opening or groove may be molded in place. The openings may be of any desired shape.

A second example of a core plug according to the present invention is shown enlarged in FIGS. 5 and 6. In this instance, the core plug 35 has a substantially solid cylindrical body portion 36 that fits tightly into the end of a core 30 and an integral tapered forward portion 37 for facilitating entry of the core plug into the core. The outer face 39 of the core plug and the cylindrical body portion 36 are each formed with a diameter that is substantially equal to the inside diameter of the core for which the core plug is intended. The inner face 38 of the core plug and the tapered forward portion 37 is of slightly less diameter than the outer face 39. The core plug 35 includes a core plug removal opening 40 that is spaced from the center of the plug and located in the outer one-half of the radius of the outer face 39. For a typical three inch diameter core plug having a one inch diameter core plug removal opening, such opening would clearly lie at or near the outer edge of the plug as shown in FIG. 3.

However, core plugs used in the paper industry vary in size from about two inches up to fourteen inches in diameter. Thus, in order to provide the optimum crush strength from such core plugs, particularly as shown by the data in Table III, the core plug removal openings must be located in the outer one-half of the radius of such plugs. Accordingly, for core plugs having a one inch diameter or larger removal opening, and an outer face diameter of four inches or greater, the edge of the opening closest to the center of the plug is spaced from the center of the core plug by a distance equal to or greater than about one-half the radius of the outer face of the core plug. However, for maximum strength core plugs according to the present invention, the opening in the core plug to facilitate its removal should be as small as possible. Thus, the opening should be only large enough to accomodate the rod or bar normally used to remove core plugs from cores.

It will thus be seen that the core plug of the present invention is distinct from prior art core plugs and because of this distinctiveness achieves a strength greater than conventional core plugs. Accordingly, while the detailed disclosure set forth above fully describes the new core plug in at least two embodiments, it is obvious that modifications and variations may be made to the core plug by those skilled in the art within the limitations of the claims appended hereto.

We claim:

1. A core plug for reinforcing and preventing damage to the ends of hollow tubular cores during shipment, said core plug comprising a solid, elongated cylindrical body with an integral tapered forward portion, formed from wood, plastic or a composite woody material having sufficient strength to absorb the impact shocks and crushing loads experienced by the cores during shipping and handling, said core plug being inserted into the ends of the cores prior to shipment, said core plug including a core plug removal opening spaced from the center thereof which extends for the full length of said cylindrical body and said integral tapered forward portion, said opening being located within the outer one-half of the radius of the cylindrical body of the plug and arranged so that the edge thereof closest to the center of the core plug is spaced from the center of the core plug by a distance equal to or greater than about one-half the radius of the cylindrical body portion for providing increased strength to the core plug, said opening being adapted to accomodate a removal tool for removing the core plug after shipment.

2. The core plug of claim 1 wherein the opening has a minimum area at the outer face of the core plug of at least about 0.2 square inch.

3. The core plug of claim 3 wherein the opening is substantially circular in cross section.

4. A core plug for reinforcing and preventing damage to the ends of hollow tubular cores during shipment, said core plug comprising a solid, elongated cylindrical body with an integral tapered forward portion, formed from wood, plastic or a composite woody material having sufficient strength to absorb the impact shocks and crushing loads experienced by the cores during shipping and handling, said core plugs being inserted into the ends of the cores prior to shipment, the improvement wherein said core plug includes a core plug removal opening spaced from the center thereof which extends for the full length of said cylindrical body and integral tapered forward portion, said opening being located wholly within the outer one-half of the radius of the cylindrical body portion of the core plug for providing increased strength to the core plug, said opening being adapted to accomodate a removal tool for removing the core plug from the cores after shipment.

* * * * *